US009593570B2

(12) United States Patent
Friend

(10) Patent No.: US 9,593,570 B2
(45) Date of Patent: Mar. 14, 2017

(54) DRILL POSITIONING SYSTEM UTILIZING DRILL OPERATION STATE

(71) Applicant: CATERPILLAR INC., Peoria, IL (US)

(72) Inventor: Paul Russell Friend, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 168 days.

(21) Appl. No.: 14/331,989

(22) Filed: Jul. 15, 2014

(65) Prior Publication Data

US 2016/0017703 A1 Jan. 21, 2016

(51) Int. Cl.

| | |
|---|---|
| ***G01V 3/00*** | (2006.01) |
| ***E21B 47/022*** | (2012.01) |
| ***E21B 7/02*** | (2006.01) |

(52) U.S. Cl.

CPC ..... *E21B 47/022* (2013.01); *E21B 7/02* (2013.01)

(58) Field of Classification Search

None

See application file for complete search history.

(56) References Cited

U.S. PATENT DOCUMENTS

| | | | | |
|---|---|---|---|---|
| 3,992,831 | A * | 11/1976 | Bukovitz | E21B 15/04 173/193 |
| 5,375,059 | A | 12/1994 | Kyrtsos et al. | |
| 5,416,712 | A | 5/1995 | Geier et al. | |
| 6,315,062 | B1 * | 11/2001 | Alft | E21B 7/046 166/255.2 |
| 8,532,899 | B1 * | 9/2013 | Loomis | G01C 9/08 340/438 |
| 2008/0109141 | A1 | 5/2008 | Nichols et al. | |
| 2014/0074397 | A1 | 3/2014 | Vanderwerf | |

FOREIGN PATENT DOCUMENTS

| | | | |
|---|---|---|---|
| CN | 103278837 | A | 9/2013 |

* cited by examiner

*Primary Examiner* — Adolf Dsouza

(74) *Attorney, Agent, or Firm* — Finnegan, Henderson, Farabow, Garrett & Dunner, LLP

(57) ABSTRACT

A method, system, and non-transitory computer-readable storage medium for estimating pose of a drill are disclosed. The method may include receiving a location signal from a locating device, receiving a first signal indicative of an angular rate of the drill, and receiving a second signal indicative of an acceleration of the drill. The method may further include determining an operation state of the drill. The method may further include determining the pose of the drill based on the received location signal, first signal, second signal, and the determined operation state of the drill.

8 Claims, 4 Drawing Sheets

DRILL POSITIONING SYSTEM UTILIZING DRILL OPERATION STATE

TECHNICAL FIELD

The present disclosure relates generally to a drill positioning system and, more particularly, to a drill positioning system utilizing the drill operation state.

BACKGROUND

Autonomously and semi-autonomously controlled machines are capable of operating with little or no human input by relying on information received from various machine systems. For example, based on machine movement input, terrain input, and/or machine operational input, a machine can be controlled to remotely and/or automatically complete a programmed task. By receiving appropriate feedback from each of the different machine systems during performance of the task, continuous adjustments to machine operation can be made that help to ensure precision and safety in completion of the task. In order to do so, however, the information provided by the different machine systems should be accurate and reliable. The pose of the machine includes parameters whose accuracy may be important for control and positioning of the machine. For example, the pose of the machine may include position, velocity, orientation, acceleration, etc. of the machine.

A drill is an example of a machine where determining an accurate pose may be important because an operator of the drill typically positions the drill at a planned hole location and drills one or more holes in a surface. Accordingly, an accurate positioning system may be desirable for a drill so that the holes can be drilled at the desired locations. Conventionally, the drill may include a positioning system that relies on Global Navigation Satellite System (GNSS) data along with data from an Inertial Measurement Unit (IMU) to calculate the pose of the drill. The IMU may consist of, for example, a 3-axis accelerometer, 3-axis angular rate gyros, and sometimes a 2-axis inclinometer.

However, when the drill is operating, the positioning system may not provide an accurate indication of the pose of the drill. For example, when a hole is being drilled using a drill bit mounted on the drill, some of the sensors (such as the inclinometers and the gyros) may not provide accurate data because of severe vibrations associated with the drilling.

U.S. Pat. No. 6,315,062 to Alft et al. ("the '062 patent") discloses an arrangement for controlling an underground boring tool using data obtained from a gyroscope, accelerometer, and magnetometer sensor provided in or proximate to the boring tool. Specifically, the '062 patent discloses that a controller produces a control signal in response to the detected boring tool location and sensed parameters of a boring tool driving apparatus. The control signal is then applied to the driving apparatus to control one or both of a rate and a direction of boring tool movement.

Although the arrangement of the '062 patent may provide a way to control the boring tool movement based on data obtained from a gyroscope, accelerometer, and magnetometer sensor, the '062 patent does not provide a way to obtain an accurate pose of the machine taking into consideration the drill operation state.

The positioning system of the present disclosure is directed toward solving one or more of the problems set forth above and/or other problems of the prior art.

SUMMARY

In one aspect, the present disclosure is directed to a method of determining pose of a drill. The method may include receiving a location signal from a locating device, receiving a first signal indicative of an angular rate of the drill, and receiving a second signal indicative of an acceleration of the drill. The method may further include determining an operation state of the drill. The method may further include determining the pose of the drill based on the received location signal, first signal, second signal, and the determined operation state of the drill.

In another aspect, the present disclosure is directed to a non-transitory computer-readable storage medium storing instructions that when executed by a processor enable the processor to execute a method for determining pose of a drill. The method may include receiving a location signal from a locating device, receiving a first signal indicative of an angular rate of the drill, and receiving a second signal indicative of an acceleration of the drill. The method may further include determining an operation state of the drill. The method may further include determining the pose of the drill based on the received location signal, first signal, second signal, and the determined operation state of the drill.

In another aspect, the present disclosure is directed to a positioning system for estimating pose of a drill. The system may include a locating device configured to generate a location signal indicative of a location of the drill. The system may also include one or more sensors configured to generate a first signal indicative of an angular rate of the drill and a second sensor indicative of an acceleration of the drill. The system may further include a controller in communication with the locating device and the one or more sensors. The controller may be configured to receive the location signal from the locating device; receive the first signal and the second signal from the sensor; and determine an operation state of the drill. The controller may be further configured to determine the pose of the drill based on the received location signal, first signal, second signal, and the determined operation state of the drill.

DETAILED DESCRIPTION

Figure 1:
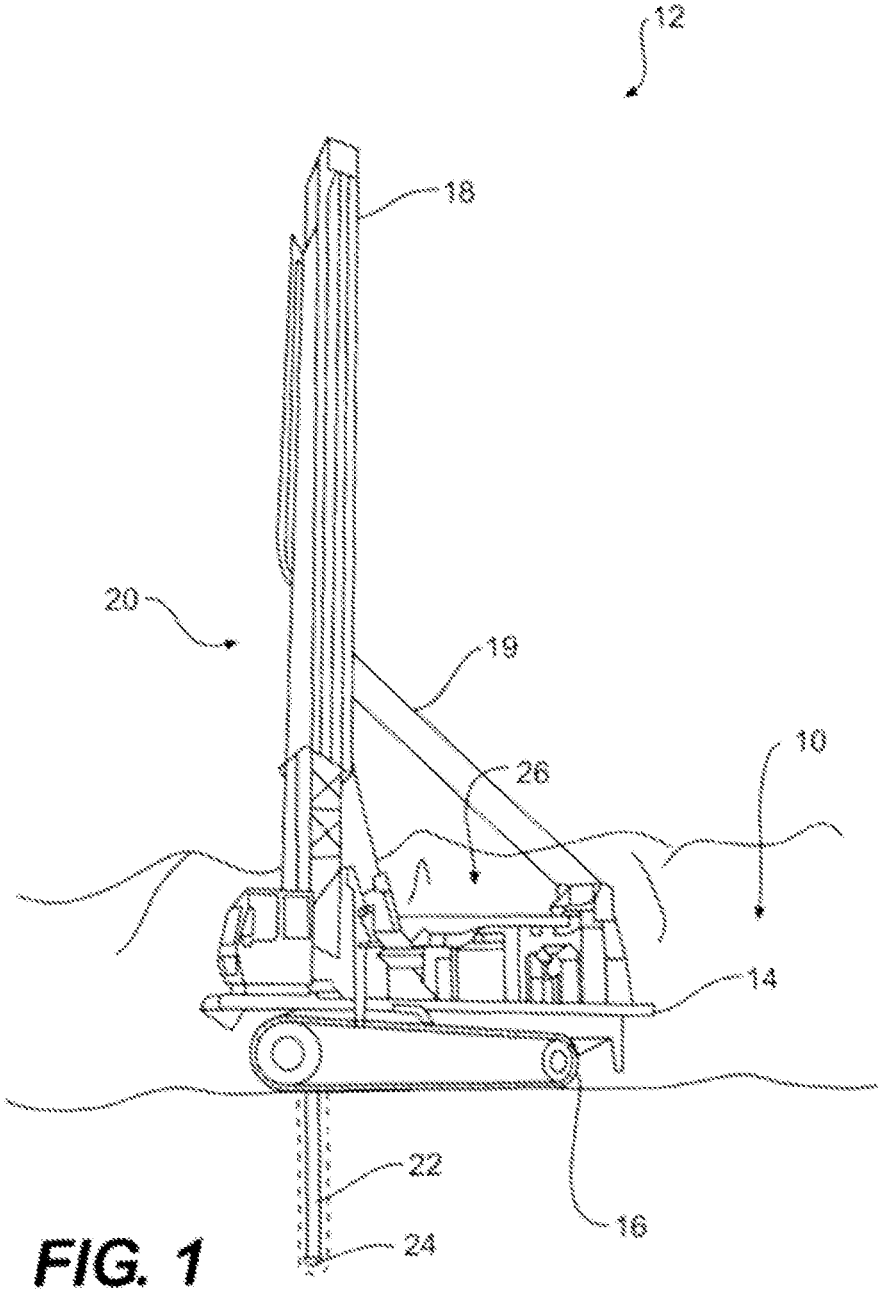
FIG. 1 is a diagrammatic illustration of an exemplary disclosed drill.

FIG. 1 illustrates an exemplary worksite 10. Worksite 10 may support a number of operations, including, for example, a mining operation. The mining operation may include sub-operations for removing and processing material, such as drilling, blasting, and hauling. The drilling sub-operation may be performed by a machine 12, and may be directed to drilling holes in a surface of worksite 10. Explosives may subsequently be placed in the drilled holes for blasting. After detonating the explosives, loose material remaining in the location of the blasting may be hauled away for removal purposes and/or processing.

Machine 12 may be a mobile machine, e.g., a drill that is configured to drill holes. Machine 12 may include a mobile platform 14 configured to move machine 12 about worksite 10. Mobile platform 14 may be coupled to a power source (not shown), such as a diesel or gas powered engine. It is also contemplated that the power source may be located remotely from machine 12. Specifically, the power source may embody a generator that is coupled to machine 12 by a length of power cable.

Machine 12 may also include a plurality of ground engaging devices 16. Ground engaging devices 16 may be configured to engage the worksite surface and propel mobile platform 14. Ground engaging devices 16 may include tracks, wheels, or any other ground engaging device known in the art. In the embodiment of FIG. 1, machine 12 includes two ground engaging devices 16, one located on either side of machine 12. It is contemplated, however, that machine 12 may have any appropriate number of ground engaging devices 16.

Machine 12 may also include a mast 18 coupled to mobile platform 14. Mast 18 may be a frame configured to hold a drill pipe 22, a drill bit 24, and a motor 26 configured to rotate or otherwise advance drill bit 24 to penetrate into the worksite surface. Mast 18 may be constructed of steel or any other appropriate material. Mast 18 may be directly pivotably connected to mobile platform 14 and may pivot by way of one or more hydraulic actuators 19. Alternatively, mast 18 may be pivotably connected to mobile platform 14 by way of a boom (not shown). It is contemplated that hydraulic actuators 19 may position mast 18 substantially perpendicular to mobile platform 14 in an extended configuration and substantially parallel to mobile platform 14 in a retracted configuration.

It is contemplated that motor 26 may be, for example, a hydraulic or electric motor powered by a power source (not shown). It is further contemplated that motor 26 may be omitted, and drill bit 24 may be driven by the power source via one or more belts and/or gear trains.

Figure 2:
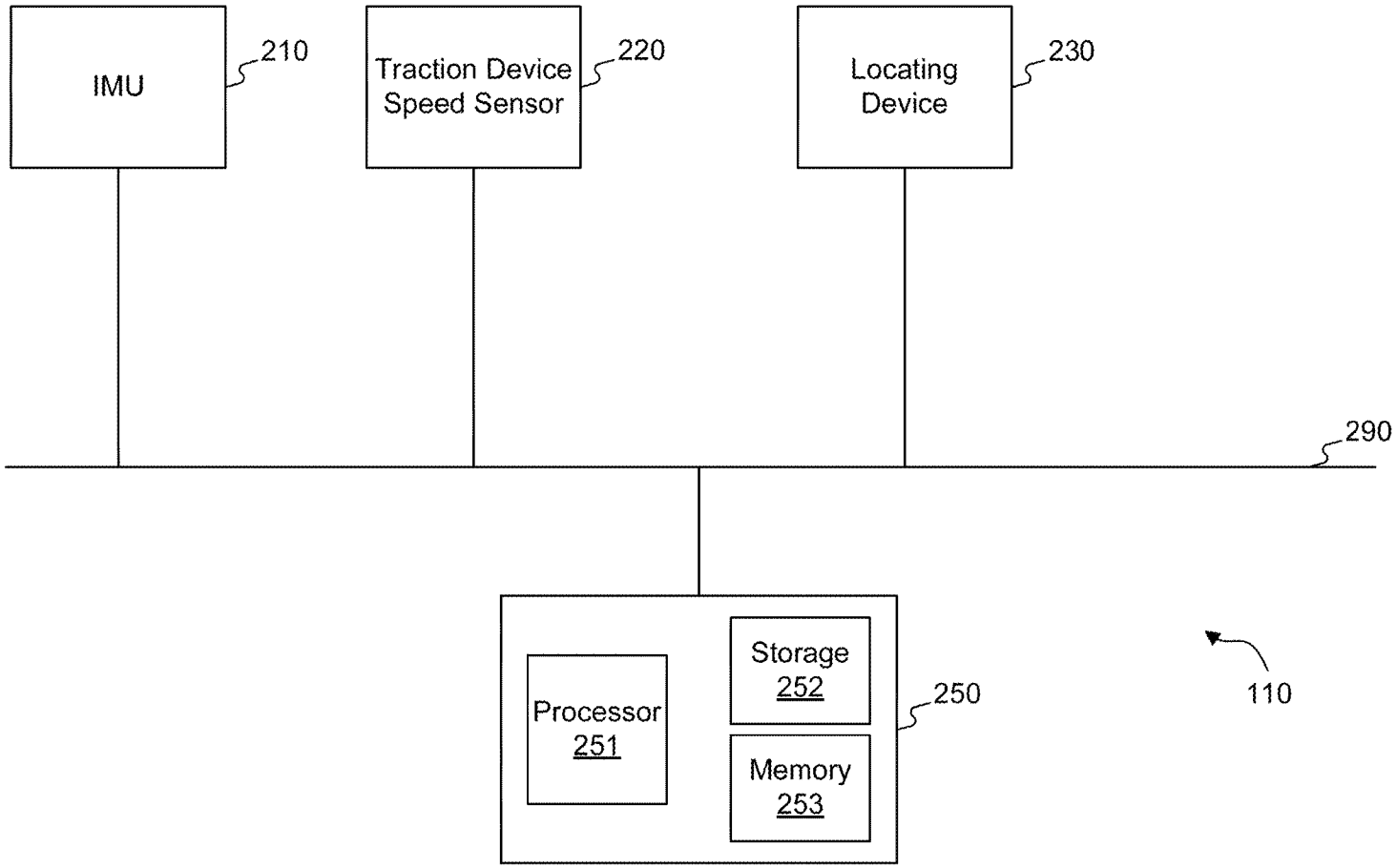
FIG. 2 is a diagrammatic illustration of an exemplary disclosed positioning system that may be used in conjunction with the drill of FIG. 1.

FIG. 2 illustrates a positioning system 110 that may be integrated with machine 12 and configured to determine a pose of machine 12. Positioning system 110 may include an IMU 210, a traction device speed sensor 220, a locating device 230, and controller 250. The above sensors and controller 250 may be connected to each other via a bus 290. While a bus architecture is shown in FIG. 2, any suitable architecture may be used, including any combination of wired and/or wireless networks. Additionally, such networks may be integrated into any local area network, wide area network, and/or the Internet.

IMU 210 may include any device (such as a gyroscope) capable of measuring an angular rate (e.g., a yaw rate, pitch rate, roll rate) of machine 12, and producing a corresponding signal. Exemplarily, IMU 210 may include a 3-axis angular rate gyro that provides signals indicative of the pitch rate, yaw rate, and roll rate of machine 100. IMU 210 may also include one or more accelerometers and/or pendulous-based inclinometers capable of measuring the acceleration of machine 12 along one or more axes.

Traction device speed sensor 220 may include any device, which provides a signal indicating a traction device speed of machine 12. For example, traction device speed sensor 220 may include a device that indicates the track speed of machine 12 or a device that indicates the wheel speed of machine 12.

Locating device 230 may include any device capable of providing a signal that indicates machine 12's location. For example, locating device 230 could embody, a global satellite system device (e.g., a GPS or GNSS device), an Inertial Reference Unit (IRU), a local tracking system, a laser range finding device, an odometric or dead-reckoning device, or any other known locating device that receives or determines positional information associated with machine 12. Locating device 230 may be configured to convey a signal indicative of the received or determined positional information to one or more of interface devices for display of machine location. The signal may also be directed to controller 250 for further processing. In the exemplary embodiments discussed herein, locating device 230 provides a GPS signal as the location signal indicative of the location of machine 12. However, it will be understood by one of ordinary skill in the art that the disclosed exemplary embodiments could be modified to utilize other indicators of the location of machine 12, if desired.

Controller 250 may include a processor 251, a storage 252, and a memory 253, assembled together in a single device and/or provided separately. Processor 251 may include one or more known processing devices, such as a microprocessor from the Pentium™ or Xeon™ family manufactured by Intel™, the Turion™ family manufactured by AMD™, or any other type of processor. Memory 253 may include one or more storage devices configured to store information used by the controller 250 to perform certain functions related to disclosed embodiments. Storage 252 may include a volatile or non-volatile, magnetic, semiconductor, tape, optical, removable, nonremovable, or other type of storage device or computer-readable medium. Storage 252 may store programs and/or other information, such as information related to processing data received from one or more sensors, as discussed in greater detail below.

In one exemplary embodiment, memory 253 may include one or more pose estimation programs or subprograms loaded from storage 252 or elsewhere that, when executed by processor 251, perform various procedures, operations, or processes consistent with disclosed embodiments. For example, memory 253 may include one or more programs that enable controller 250 to, among other things, collect data from the above-mentioned units and process the data according to disclosed embodiments such as those embodiments discussed with regard to FIGS. 3 and 4, and determine a pose of machine 12 based on the processed data.

In certain embodiments, memory 253 may store program enabling instructions that configure controller 250 (more particularly, processor 251) to implement a method that uses a Kalman filter to estimate a pose of machine 12. A Kalman filter is a mathematical method that may be used to determine accurate values of measurements observed over time, such as measurements taken in a time series. The Kalman filter's general operation involves two phases, a propagation or "predict" phase and a measurement or "update" phase. In the predict phase, the value estimate from the previous timestep in the time series is used to generate an a priori value estimate. In the update phase, the a priori estimate calculated in the predict phase is combined with an estimate of the accuracy (e.g., the variance) of the a priori estimate, and a current measurement value to produce a refined a posteriori estimate.

In certain exemplary embodiments, controller 250 may be configured to utilize the following equations in its calculations. For the propagation or "predict" phase, controller 250 may be configured to utilize the following generic equations:

$$\hat{x}_k^- = F_{k-1}\hat{x}_{k-1} + G_{k-1}u_{k-1} \tag{1}$$

$$P_k^- = F_{k-1}P_{k-1}^+F_{k-1}^T + Q_{k-1} \tag{2}$$

For the measurement or "update" phase, controller 250 may be configured to utilize the following generic equations:

$$K_k=P_{k-1}^{-}H^T(H_kP_{k-1}^{-}H_k^T+R_k)^{-1} \quad (3)$$

$$\hat{x}_k^{+}=\hat{x}_k^{-}+K_k(y_k-H_k\hat{x}_k^{-}) \quad (4)$$

$$P_k^{+}=(I-K_kH_k)P_k^{-} \quad (5)$$

In the above equations, $\hat{x}_k^{-}$ may be the a priori state estimate of a certain state variable (e.g., pitch, yaw, roll, position, velocity, etc.) that is calculated based on a value ($\hat{x}_{k-1}$) of the state variable from an immediately preceding time step. F, G, and H may be appropriate state transition matrices. In the measurement or "update" phase, controller 250 may calculate the Kalman gain $K_k$ utilizing equation (3), in which P is an error covariance matrix and R is a matrix setting forth the variance associated with the different state variables. For example, the values in the R matrix may specify the uncertainty associated with the measurement of a given state variable. In the measurement phase, controller 250 may also obtain an independent measure of the state variable and set the independent measure as $y_k$. Utilizing the a priori estimate $\hat{x}_k^{-}$ from the "predict" phase, measurement $y_k$, and the Kalman gain $K_k$, controller 250 may calculate the a posteriori state estimate $\hat{x}_k^{+}$ utilizing equation (4).

Figure 3:
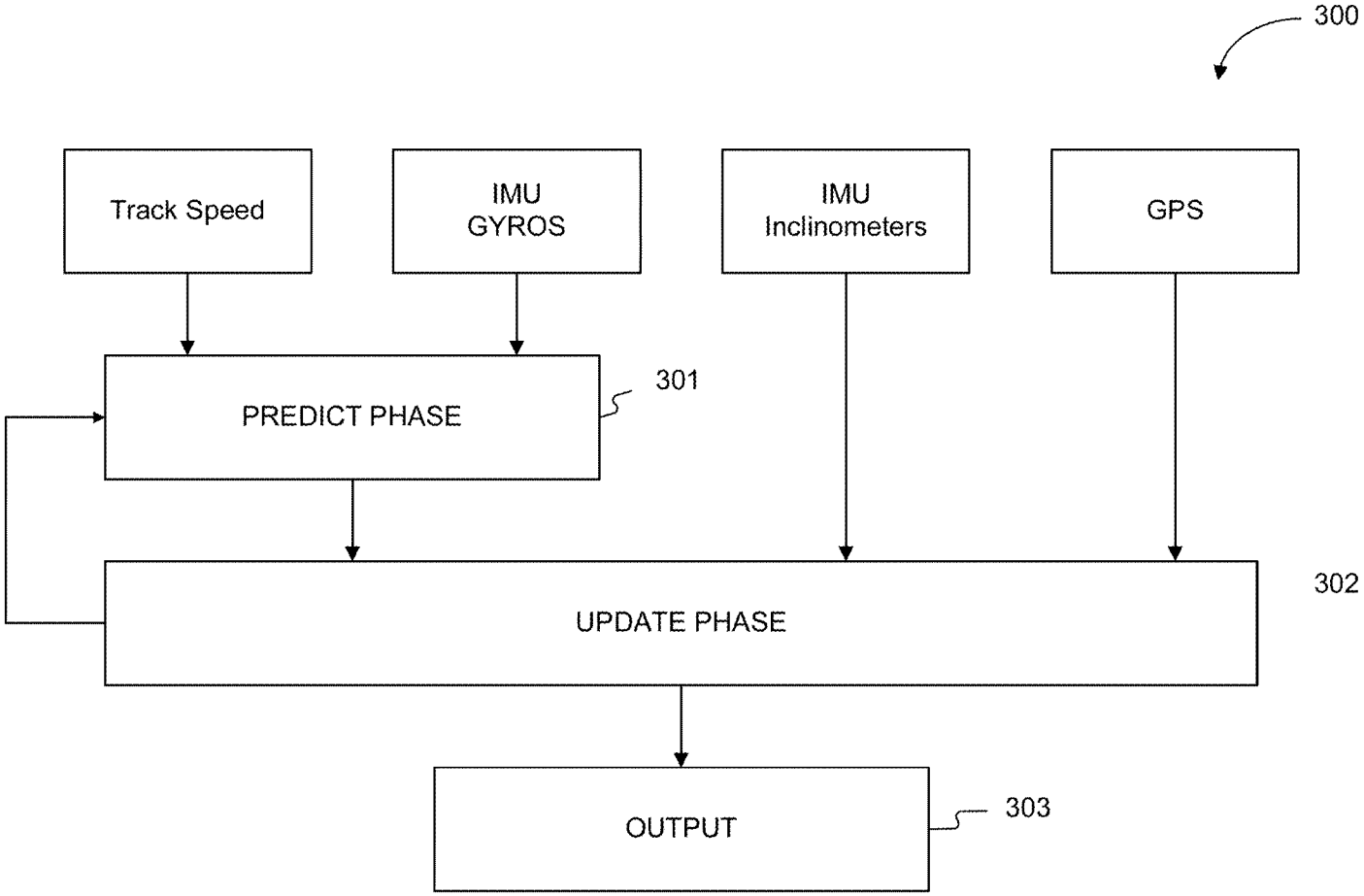
FIG. 3 is a diagrammatic illustration of an exemplary Kalman filter that may be implemented as part of the exemplary positioning system of FIG. 2.

FIG. 3 illustrates an exemplary configuration for a Kalman filter 300 implemented by controller 250. In the predict phase 301 of Kalman filter 300, controller 250 may utilize one or more inputs from IMU 210 (such as the angular rates from the IMU 210 gyros) and traction device speed sensor 220 to calculate an a priori state estimate of a certain state variable (e.g., pitch, yaw, roll, position, velocity, etc.) In predict phase 301, controller 250 may execute equations (1) and (2). For example, in the predict phase, controller 250 may calculate $\hat{x}_k^{-}$ (a priori state estimate) of one or more state variables using a value ($\hat{x}_{k-1}$) of the state variable from an immediately preceding time step and the inputs from IMU 210 and/or traction device speed sensor 220. Exemplarily, $\hat{x}_{k-1}$ may be obtained from the update phase 302 as the output value of the immediately preceding time step.

Following the predict phase 301, controller 250 may implement the update phase 302 to calculate the a posteriori state estimate $\hat{k}_k^{+}$ utilizing, for example, equation (4). For example, controller 250 may calculate the a posteriori state estimate $\hat{x}_k^{+}$ using the a priori estimate $\hat{x}_k^{-}$ from the predict phase 301, measurement $y_k$, and the Kalman gain $K_k$ As shown in FIG. 3, controller 250 may also receive as input, in the update phase 302, acceleration values from IMU 210 inclinometers and location signal from locating device 230. Controller 250 may set the input received from locating device 230 and IMU 210 inclinometers as the measurement $y_k$ in equation (4). Additionally, controller 250 may smooth the acceleration values from IMU 210 inclinometers and the location signal prior to utilizing them in equation (4). For example, controller 250 may apply the following low-pass filter to the input inclinometer value and the location signal value:

$$\text{Filtered Output}=(\text{Coeff})*\text{Previous Filtered Output}+(1-\text{Coeff})*\text{New Input Value} \quad (6)$$

In equation (6) above, controller 250 may set the coefficient value (Coeff) based on the operation state of machine 12. This aspect is discussed in detail below with reference to FIG. 4. Also, as discussed above, controller 250 may execute equations (3) and (5) in the update phase. Using the above, controller 250 may generate the a posteriori state estimate $\hat{x}_k^{+}$ as output 303. Without limitation, the a posteriori state estimate $\hat{x}_k^{+}$ may include the pose of machine 12 that may include parameters such as velocity, position, acceleration, orientation, etc.

In determining the pose of machine 12 using Kalman filter 300, controller 250 may also consider the operation state of machine 12. For example, if machine 12 is a drill, controller 250 may consider whether machine 12 is driving, leveling, adjusting mast 18, drilling, changing drill bit 24, etc. When machine 12 is in one or more of the above operation states, controller 250 may change certain parameters of Kalman filter 300 to reflect the accuracy or confidence in certain input parameters. For example, when machine 12 is driving from one location to another, controller 250 may lower the weighting applied to the input from the IMU 210 inclinometers. To lower the weighting applied to the inclinometer input, controller 250 may increase the value of variance 'R' associated with the inclinometer input in equation (3). Similarly, when machine 12 is leveling, controller 250 may increase the weighting applied to the inclinometer input to reflect a higher confidence in the accuracy of the inclinometer input. For example, to indicate a higher confidence in accuracy, controller 250 may decrease the value of 'R' associated with the inclinometer input.

Figure 4:
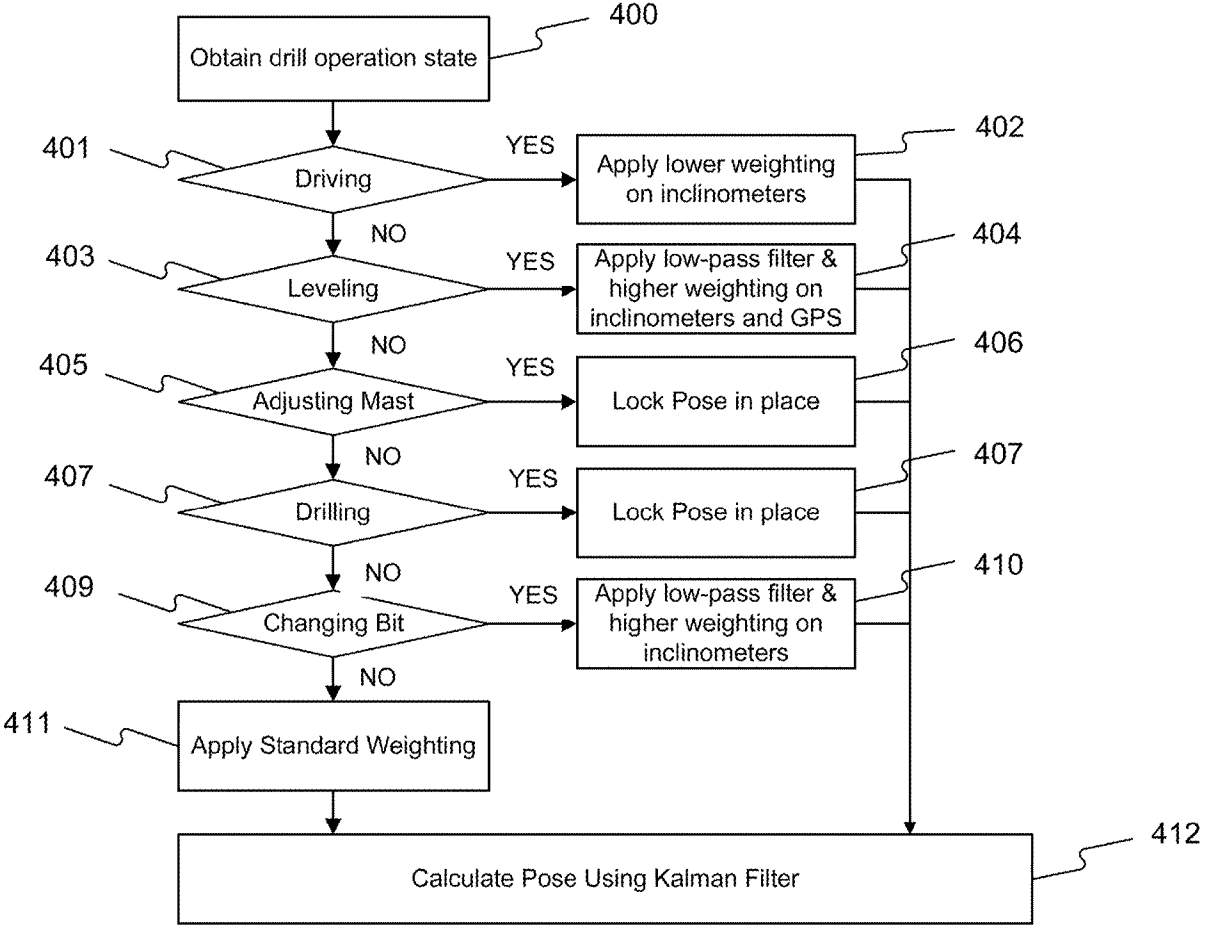
FIG. 4 is a flowchart illustrating an exemplary method performed by the disclosed positioning system.

FIG. 4 further describes exemplary operations of controller 250 to estimate the pose of machine 12 considering the operation state of machine 12. A detailed description of FIG. 4 is provided in the next section.

INDUSTRIAL APPLICABILITY

The disclosed positioning system 110 may be applicable to any machine where accurate detection of the machine's pose is desired. The disclosed positioning system 110 may provide for improved estimation of the pose of machine 12, such as a drill, by considering an operation state of machine 12. Operation of the positioning system 110 will now be described in connection with the flowchart of FIG. 4. The exemplary steps of FIG. 4 assume that machine 12 is a drill 12. However, it will be apparent that the exemplary steps of FIG. 4 may be implemented by any machine where the machine operation state is considered in determining the machine's pose.

In step 400, controller 250 may obtain the drill operation state. The drill operation state may be obtained from another device of drill 12 or controller 250 may independently determine the drill operation state based on inputs received from other device(s) of drill 12. Exemplarily, obtaining or determining the drill operation state may include determining whether drill 12 is driving, leveling, adjusting its mast 18, drilling, or changing drill bit 24.

In step 401, controller 250 may determine whether drill 12 is driving. If drill 12 is driving (step 401: YES), controller 250 may execute step 402 and apply a lower weighting to the input from IMU 210 inclinometers. Exemplarily, to apply a lower weighting to the inclinometer input, controller 250 may increase the value of variance R associated with the inclinometer input in equation (3) above. For example, controller 250 may increase the variance R to 1 degree for the inclinometers from a normal setting of 0.5 degrees. Controller 250 may also set the low-pass filter coefficient value (Coeff) as 0.8, for example, in equation (6). It will be understood that the above values are only examples and any other suitable values may be utilized.

If controller 250 determines that drill 12 is not driving (step 401: NO), controller 250 may execute step 403 to determine whether drill 12 is leveling. If controller 250 determines that drill 12 is leveling (step 403: YES), controller 250 may execute step 404 and apply a low-pass filter and higher weighting to the inclinometer input from IMU 210 and locating signal from locating device 230. As discussed earlier, the locating signal from locating device 230 may be a GPS signal. In applying the low-pass filter, controller 250 may increase the coefficient value (Coeff) for both the inclinometer input and the GPS signal. For example, controller 250 may set a coefficient value for both to 0.99. To apply the higher weighting, controller 250 may set the variance R for the inclinometer input to 0.1 degrees and to 0.05 meters for the GPS signal. The GPS signal variance may normally be set to 0.1 meters. Again, it will be understood that the above values are only examples and any other suitable values may be utilized.

If controller 250 determines that drill 12 is not leveling (step 403: NO), controller 250 may determine in step 405 whether mast 18 is being adjusted. If controller 250 determines that mast 18 is being adjusted (step 405: YES), controller 250 may execute step 406 and lock the current pose of drill 12 until the condition of step 405 continues to be satisfied. If controller 250 determines that drill 12 is not leveling (step 405: NO), controller 250 may determine in step 407 whether drill 12 is drilling. If controller 250 determines in step 407 that drill 12 is drilling (step 407: YES), controller 250 may execute step 408 and again lock the current pose of drill 12.

If controller 250 determines in step 407 that drill 12 is not drilling (step 407: NO), controller 250 may determine in step 409 whether drill bit 24 is being changed. If controller 250 determines in step 409 that drill bit 24 is being changed (step 409: YES), controller 250 may execute step 410 and apply a low-pass filter and higher weighting to the IMU 210 inclinometers. For example, controller 250 may set the value of Coeff to 0.99 for the inclinometer input in equation (6) and may decrease the variance R for the inclinometer input. Exemplarily, controller 250 may decrease the variance R for the inclinometer input to 0.1 degrees.

If controller 250 determines in step 409 that drill bit 24 is not being changed (step 409: NO), controller 250 may executed step 411 and apply standard weighting to the inclinometer and GPS inputs. For example, controller 250 may apply a variance R (equation (3)) of 0.5 degrees for the inclinometer input and the 0.1 meters for the GPS input. Again, it will be understood that the above values are only examples and any other suitable values may be utilized. In step 412, controller 250 may calculate the pose of drill 12 using the Kalman filter equations (1)-(5). Controller 250 may output the calculated pose as desired. Controller 250 may also control the operation of devices of drill 12 based on the calculated pose. For example, controller 250 may control the drilling of holes using drill 12 based on the calculated pose.

The disclosed exemplary embodiments may allow for an accurate estimation of the pose of machine 12 and, in particular, drill 12. For example, by utilizing the drill operation state, accurate estimation of the pose of drill 12 may be possible.

It will be apparent to those skilled in the art that various modifications and variations can be made to the disclosed embodiments. Other embodiments will be apparent to those skilled in the art from consideration of the specification and practice of the disclosed embodiments. It is intended that the specification and examples be considered as exemplary only, with a true scope being indicated by the following claims.

What is claimed is:

1. A method for determining the pose of a drilling machine, comprising:

receiving a location signal from a GPS indicative of a location of the drilling machine;

receiving a first signal from a gyro indicative of an angular rate of the drilling machine;

receiving a second signal from an inclinometer indicative of an acceleration of the drilling machine;

determining an operation state of the drilling machine; and determining, using a Kalman filter, the pose of the drill based on the received location signal, first signal, second signal, and the determined operation state of the drilling machine; and determining that the drilling machine is driving, and in response to determining that the drilling machine is driving, increasing a variance value for the second signal.

2. The method of claim 1, wherein determining the pose using the Kalman filter includes:

determining that the drilling machine is leveling, and in response to determining that the drilling machine is leveling, decreasing a variance value for the second signal and the location signal.

3. The method of claim 1, wherein determining the pose using the Kalman filter includes:

determining that the drilling machine is drilling, and in response to determining that the drilling machine is drilling, locking a current pose of the drilling machine until the drilling machine is not drilling.

4. A positioning system for estimating pose of a drilling machine, comprising:

a locating device configured to generate a location signal from a GPS indicative of a location of the drilling machine;

one or more sensors configured to generate a first signal from a gyro indicative of an angular rate of the drilling machine and a second signal from an inclinometer indicative of an acceleration of the drilling machine; and a controller in communication with the locating device and the one or more sensors, the controller configured to:

receive the location signal from the locating device;

receive the first signal and the second signal from the one or more sensors;

determine an operation state of the drilling machine; and determine, using a Kalman filter, the pose of the drilling machine based on the received location signal, first signal, second signal, and the determined operation state of the drilling machine;

determine that the drilling machine is driving, and in response to determining that the drilling machine is driving, increasing a variance value for the second signal.

5. The positioning system of claim 4, wherein determining the pose using the Kalman filter includes:

determining that the drilling machine is leveling, and in response to determining that the drilling machine is leveling, decreasing a variance value for the second signal and the location signal.

6. The positioning system of claim 4, wherein determining the pose using the Kalman filter includes:

determining that the drilling machine is drilling, and in response to determining that the drilling machine is drilling, locking a current pose of the drilling machine until the drilling machine is not drilling.

7. A non-transitory computer-readable storage medium storing instructions that when executed by a processor enable the processor to execute a method for determining pose of a drilling machine, the method comprising:

receiving a location signal from a GPS indicative of a location of the drilling machine;

receiving a first signal from a gyro indicative of an angular rate of the drilling machine;

receiving a second signal from an inclinometer indicative of an acceleration of the drilling machine;

determining an operation state of the drilling machine; and determining, using a Kalman filter, the pose of the drilling machine based on the received location signal, first signal, second signal, and the determined operation state of the drilling machine;

determining that the drilling machine is driving, and in response to determining that the drilling machine is driving, increasing a variance value for the second signal.

8. The non-transitory computer-readable storage medium of claim 7, wherein determining the pose using the Kalman filter includes:

determining that the drilling machine is leveling, and in response to determining that the drilling machine is leveling, decreasing a variance value for the second signal and the location signal.

* * * * *